US005735164A

United States Patent [19]

Heitze et al.

[11] Patent Number: 5,735,164

[45] Date of Patent: Apr. 7, 1998

[54] UPSETTING TOOL OF A PAIR OF UPSETTING TOOLS FOR THE DEFORMATION OF CONTINUOUSLY CAST SLABS IN A SLAB UPSETTING PRESS

[75] Inventors: Gerhard Heitze, Netphen; Adolf Müller, Wilnsdorf; Günter Kneppe, Hilchenbach, all of Germany

[73] Assignee: SMS Schloemann-Siemag Aktiengesellschaft, Düsseldorf, Germany

[21] Appl. No.: 682,444

[22] Filed: Jul. 17, 1996

[30] Foreign Application Priority Data

| | | | |
|---|---|---|---|
| Jul. 19, 1995 | [DE] | Germany | 195 26 279.4 |
| Sep. 28, 1995 | [DE] | Germany | 195 36 044.3 |
| Jan. 9, 1996 | [DE] | Germany | 196 00 477.2 |
| Feb. 8, 1996 | [DE] | Germany | 196 04 596.7 |

[51] Int. Cl.[6] ..... B21B 15/00; B21J 7/14

[52] U.S. Cl. ..... 72/416; 72/184; 72/206; 72/407

[58] Field of Search ..... 72/407, 416, 412, 72/184, 206, 402

[56] References Cited

U.S. PATENT DOCUMENTS

| | | | |
|---|---|---|---|
| 2,178,141 | 10/1939 | Frame | 72/402 |

FOREIGN PATENT DOCUMENTS

| | | | |
|---|---|---|---|
| 0112516 | 7/1984 | European Pat. Off. . | |
| 56750 | 5/1981 | Japan | 72/416 |
| 238385 | 8/1994 | Japan | 72/416 |

OTHER PUBLICATIONS

Patent Abstracts of Japan vol .012, No. 251 of July 15, 1988: JP-A-59 036902 (Sumitomo Metal Ind Ltd) of Feb. 17, 1988.

Patent Abstracts of Japan vol .015, No. 249 of Jun. 25, 1991: JP-A-03 081005 (Ishikawajima Harima Heavy Ind Co Ltd) of Apr. 5, 1991.

*Primary Examiner*—Daniel C. Crane
*Attorney, Agent, or Firm*—Friedrich Kueffner

[57] ABSTRACT

An upsetting tool of a pair of upsetting tools for the deformation of continuously cast slabs in a slab upsetting press is composed of two connecting rods which are driven through two eccentric shafts and which support the upsetting tool and guide the upsetting tool in parallel direction. Hinged to the connecting rods is a piston/cylinder unit for producing a movement of the upsetting tool synchronously with the slab movement on a roller table. The upsetting tool has upsetting surfaces for acting on one of the two longitudinal sides of the slab. The upsetting surfaces extend parallel or inclined relative to the direction of movement of the slab. The upsetting surfaces are located next to one another so as to form edges extending transversely of the direction of movement of the slab, wherein upsetting surfaces inclined away from the longitudinal side surfaces of the slab are arranged following or possibly in front of an upsetting surface extending parallel to the travel direction of the slab. Each upsetting tool has a first inclined upsetting surface and one or more additional upsetting surfaces with angles of inclination which are smaller than the angle of inclination of the first upsetting surface.

19 Claims, 7 Drawing Sheets

UPSETTING TOOL OF A PAIR OF UPSETTING TOOLS FOR THE DEFORMATION OF CONTINUOUSLY CAST SLABS IN A SLAB UPSETTING PRESS

BACKGROUND OF THE INVENTION

1. Field of the Invention

The present invention relates to an upsetting tool of a pair of upsetting tools for the deformation of continuously cast slabs in a slab upsetting press. The support unit of the upsetting tools is composed of two connecting rods which are driven through two eccentric shafts and which support the upsetting tool and guide the upsetting tool in parallel direction. Hinged to the connecting rods is a piston/cylinder unit for producing a movement of the upsetting tool synchronously with the slab movement on the roller table. The upsetting tool has upsetting surfaces for acting on one of the two longitudinal sides of the slab. The upsetting surfaces extend parallel or inclined relative to the direction of movement of the slab or of the longitudinal side surfaces of the slab. The upsetting surfaces are located next to one another so as to form edges extending transversely of the direction of movement of the slab, wherein upsetting surfaces inclined away from the longitudinal side surfaces of the slab are arranged following or possibly in front of an upsetting surface extending parallel to the travel direction of the slab.

2. Description of the Related Art

As described in "Iron and Steel", September 1990, the slabs to be upset are placed on a roller table centrally between two upsetting tools forming a pair and are moved and worked on in such a way that the slabs are subjected to an upsetting flow deformation on their two longitudinal surfaces by the respective upsetting surfaces of the upsetting tools, wherein the slabs are either standing still or are being moved, with a synchronous movement of the upsetting tools taking place transversely of the upsetting pressing direction. The upsetting flow deformation has the result that the slab is pressed in a first processing step into a so-called dog-bone section, as seen from above. The narrow portion of this section is determined with respect to its shape and dimensions by the upsetting surfaces. In the subsequent processing steps, the two upsetting tools are moved apart from each other on the roller table transversely of the travel direction of the slab and the slab is simultaneously moved ahead by a predetermined distance and the wider portion of the dog-bone section reaches the area of those ends of the two oppositely located upsetting surfaces which are located closer to each other. In this position, the slab is once again stopped and the upsetting tools subject the subsequent portions of the slab which have not yet been upset to a continued upsetting flow deformation.

It has already been proposed to combine the successive deformation steps and the forward movement of the slab, i.e., not to interrupt the forward movement of the slabs and to synchronize the forward movement of the upsetting tools with the speed of movement of the slabs, so that the upsetting tools, while contacting the side walls of the slab, deformed the slab over a predetermined length. After this predetermined length has been travelled, this deformation step and the contact of the upsetting tools with the slab are concluded. Accordingly, the upsetting tools are moved initially together with and then against the travel direction of the slabs toward their respective dead center positions, while the slab is uniformly moved ahead by the subsequent predetermined length.

The upsetting procedures carried out with the above-described upsetting tools make it possible to produce relatively plane side wall surfaces of the slab. However, these upsetting procedures frequently produce irregularities in the form of wave-shaped raised areas at the side walls of the slab. These raised areas extend transversely of the longitudinal direction of the side walls and in a more or less regular sequence over the length of the side walls of the slab.

While it has been attempted to counteract the formation of these wave-shaped raised areas by changing the feeding distances and feeding speeds in conjunction with the time sequence of the movements of the upsetting tools and also by using upsetting tools with different angles of inclination of the upsetting surfaces, and while these attempts did reduce these phenomena, the formation of these wave-shaped raised areas could not be completely prevented.

SUMMARY OF THE INVENTION

Therefore, it is the primary object of the present invention to improve the known upsetting tools in such a way that the formation of the above-described wave-shaped raised areas is prevented.

In accordance with the present invention, each upsetting tool has a first inclined upsetting surface and one or more additional upsetting surfaces with angles of inclination which are smaller than the angle of inclination of the first upsetting surface.

This configuration of the upsetting tool has the result that the above-described wave-shaped raised areas, which are produced during the upsetting flow deformation apparently primarily in the area of the transition edge between the upsetting surface and the parallel upsetting surface, are pressed away by the additional upsetting surfaces in a processing step which is similar to rolling. On the other hand, depending on the given upsetting pressing conditions and also the properties of the material of the slab, it is possible that the formation of the wave-shaped raised areas is prevented from the outset.

The present invention provides that the angles of inclination of the additional upsetting surfaces may be either different from each other or equal to each other.

In upsetting tools having two additional upsetting surfaces, it is advantageous to dimension the distance between the two edges of the first additional upsetting surface adjacent the transition edge of the upsetting surface shorter than the distance between the two edges of the second additional upsetting surface located adjacent the first additional upsetting surface, as measured in the plane of the upsetting calibrating surface which extends parallel to the direction of movement of the slab. The distance between the edges of the first additional upsetting surface may by approximately half the distance between the edges of the second additional upsetting surface. Moreover, measured from the transition edge of the second additional upsetting surface to the free end of this surface, the length of the parallel upsetting surface may be approximately a third of the length of the parallel upsetting surface of a comparable upsetting tool having only one upsetting surface.

The vertical distance of the transition edge of the first upsetting surface from the plane of the parallel upsetting surface may correspond approximately to the height of the side wall deformation which is produced during upsetting pressing of a slab using a comparable upsetting tool having only one upsetting surface.

The present invention further provides that an upsetting tool having the features of the invention can be manufactured from an upsetting tool having only one upsetting surface and an upsetting calibrating surface adjacent the transition edge of the upsetting surface by removing material to obtain the two transitional upsetting surfaces in such a way that the transition edge of the upsetting surface is located in an area in front of and above its original position and the length of the parallel upsetting surface is reduced to approximately a third of its original length.

It has been found during practical use of the configuration according to the present invention that, particularly when the angle of inclination of the first upsetting surface is approximately 11°–13°, preferably 12°, the angle of inclination of the additional upsetting surfaces should be between 0.5° and 8° if the wave-shaped raised areas are to eliminated practically without residue. It has been found particularly advantageous if the upsetting tool is dimensioned in such a way that the angle of inclination of the first additional upsetting surface adjacent the first upsetting surface is 5° and the angle of inclination of the second additional upsetting surface adjacent the first additional upsetting surface is 1°. It has also been found very advantageous if the angle of inclination of the first additional upsetting surface is 0.5°–2° and the angle of inclination of the second additional upsetting surface is 4°–8°.

In practical use of the embodiments of the present invention it has been found that, in an embodiment in which three additional upsetting surfaces are provided, the wave-shaped raised areas can be eliminated practically without residue particularly if the angle of inclination of the first upsetting surface is about 19°–20°, preferably 19.8°, and the angles of inclination of the three additional upsetting surfaces are in a range of between 0.9° and 10°, preferably, 0.91° and 9.8°. It has been found particularly advantageous if the dimensions are selected in such away that the angle of inclination of the first additional upsetting surface adjacent the first upsetting surface is 9.1°, the angle of inclination of the second additional upsetting surface adjacent the first additional upsetting surface is 5.2° and the angle of inclination of the third additional upsetting surface adjacent the second additional upsetting surface is 0.91° and the parallel upsetting surface adjacent the third additional upsetting surface is followed by a transition surface having an inclination angle of 12°.

It is also possible, if the first upsetting surface has an angle of inclination of approximately 12°, to provide two additional upsetting surfaces with angles of inclinations of 5.2° and 0.91°, respectively, and to provide a transition surface with an angle of inclination of 12°.

However, the upsetting tools described above still do not provide a satisfactory material flow during upsetting at the slab head and at the slab end. Depending on the reduction, the slab head frequently becomes inclined. This has the result that the width of the slab head is smaller than the width of the slab middle. At the slab end, the material is shaped by the upsetting surface which is appropriately inclined against the direction of movement of the slab. This has the result that the dog bone is shaped differently at the slab head and the slab end as compared to the middle of the slab.

In accordance with another proposal of the present invention, these disadvantages can be eliminated by forming the upsetting surface of the upsetting tool by two or more groups of upsetting surfaces which are each composed of an upsetting surface extending parallel to the travel direction of the slab and upsetting surfaces forming a polygonal configuration with inclination angles of increasing magnitude in front of the parallel upsetting surface in the direction toward the entry at the pressing gap formed by the upsetting tools. It has been found advantageous to form altogether three groups of such upsetting surfaces. This causes the material flow pattern at the slab head and at the slab end to be much more favorable. The dog bone shape extends more uniformly over the entire length of the slab.

The upsetting tools having the above-described configuration can be used in a slab upsetting press in such a way that, independently of the respective position of the slab head to the position of the pair of upsetting tools, the slab is moved by means of the roller table toward the pressing gap formed by the pair of upsetting tools and is accelerated before reaching the pressing gap to the precalculated feeding speed and the width of the slab is reduced by the pair of upsetting tools in successive upsetting strokes, wherein the phases of contact between the upsetting tools of the pair of upsetting tools and the slab and the forward movement of the upsetting tools and the slab take place synchronously.

However, the slab can also be moved by means of the roller table for the first pressing application of the upsetting tools into a precalculated position for the slab head between the upsetting tools. The successive upsetting strokes can be dimensioned with different lengths while being adapted to the respectively required feeding speed and synchronization of the movements of the slab and the upsetting tools. The different stroke lengths can then be dimensioned in such a way that the contact between the upsetting tools and the slab during the last pressing stroke takes place at a locally prepared location of the upsetting surfaces of the upsetting tools.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENT

Figure 1:
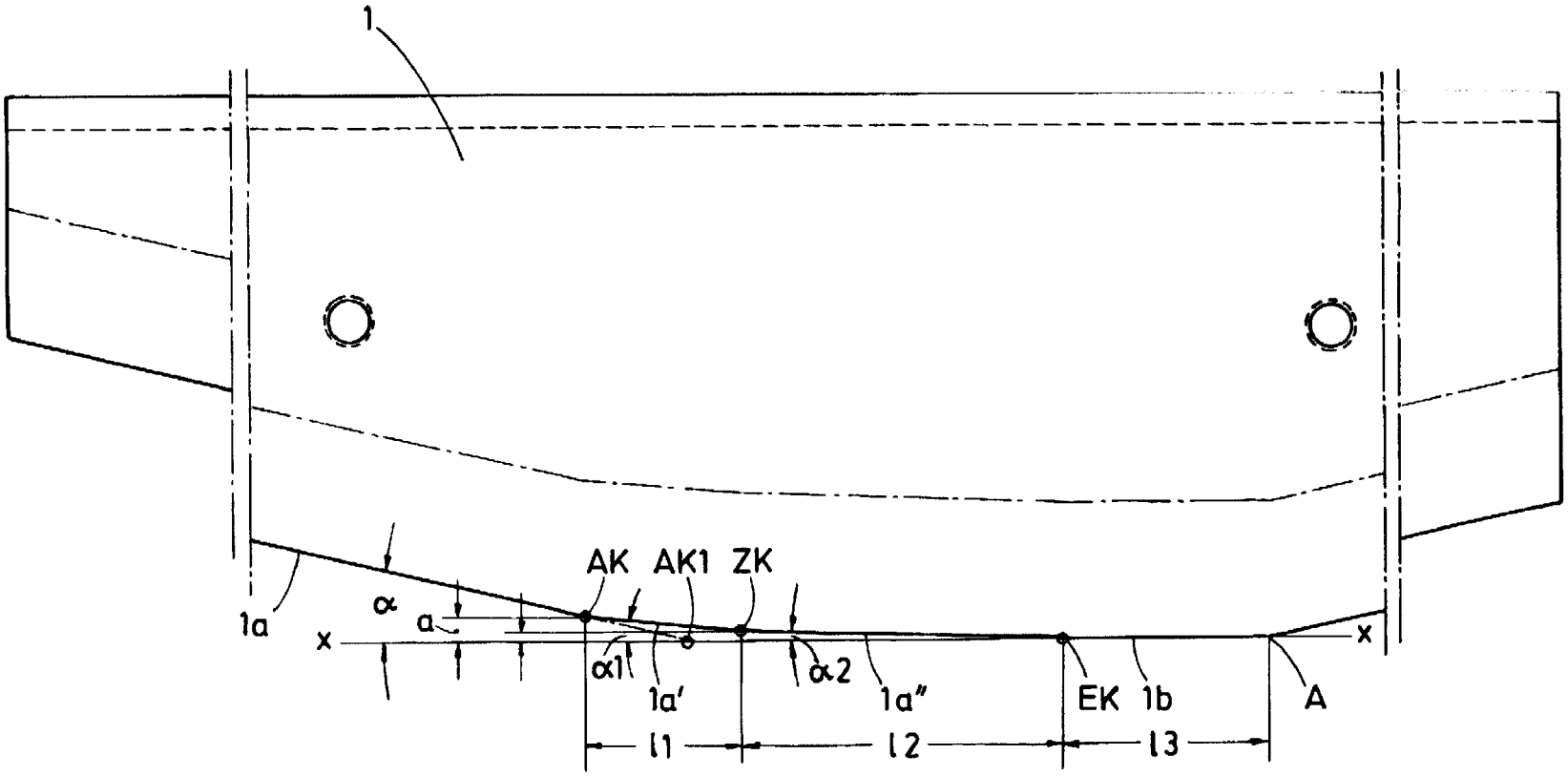
FIG. 1 is a top view of an upsetting tool.

As illustrated in FIG. 1 of the drawing, a part 1 of a pair of upsetting tools has a first upsetting surface 1*a* and an upsetting surface 1*b* extending parallel to the travel direction of the slab. The first upsetting surface 1*a* extends at an angle of inclination α relative to the plane x—x of the parallel upsetting surface 1*b*. Additional upsetting surfaces 1*a'* and 1*a"* are arranged following the transition edge AK of the first upsetting surface 1*a*. These two additional upsetting surfaces 1*a'* and 1*a"* extend at angles of inclination α1 and α2, respectively, relative to the plane x—x of the parallel upsetting surface 1*b* which are smaller than the angle of inclination α of the first upsetting surface relative to the plane x—x. As can be seen in FIG. 1, in the illustrated embodiment, the distance L1 between the two transition edges of the first additional upsetting surface 1*a'* following the first upsetting surface 1*a*, i.e., the transition edges AK and the intermediate edge ZK, as measured on the plane x—x of the parallel upsetting surface 1*b*, is shorter than the distance L2 between the two transition edges of the second additional upsetting surface 1*a*" following the first additional upsetting surface 1*a*', i.e., the intermediate edge ZK and the end transition edge EK. In the illustrated embodiment, the distance L1 between the transition edges AK and ZK of the first additional upsetting surface 1*a*' is approximately half of the distance L2 between the transition edges ZK and EK of the second additional upsetting surface 1*a*'. The length L3 of the parallel upsetting surface 1*b* measured between the end transition edge EK of the second additional upsetting surface 1*a*" and the free transition A of this parallel upsetting surface 1*b* is approximately one third of the length of the parallel upsetting surface of a comparable upsetting tool having only one upsetting surface whose transition edge position is indicated on a dash-dot line with AK'.

The vertical distance a of the transition edge AK from the plane x—x of the parallel upsetting surface 1*b* can be dimensioned in such a way that it corresponds approximately to the height of the side wall deformation, not shown, which is produced during upsetting pressing of a slab with an upsetting tool which has an upsetting surface whose transition edge assumes the above-described position AK'.

The upsetting tool illustrated in FIG. 1 is manufactured by removing material from an upsetting tool having only one upsetting surface and the resulting above-described position of the transition edge AK' in such a way that the transition edge AK of the first upsetting surface 1*a* is moved into an area in front of and above its original position AK' and the length of the parallel upsetting calibrating surface 1*b* is reduced to the above-mentioned third of its original length.

Figure 2:
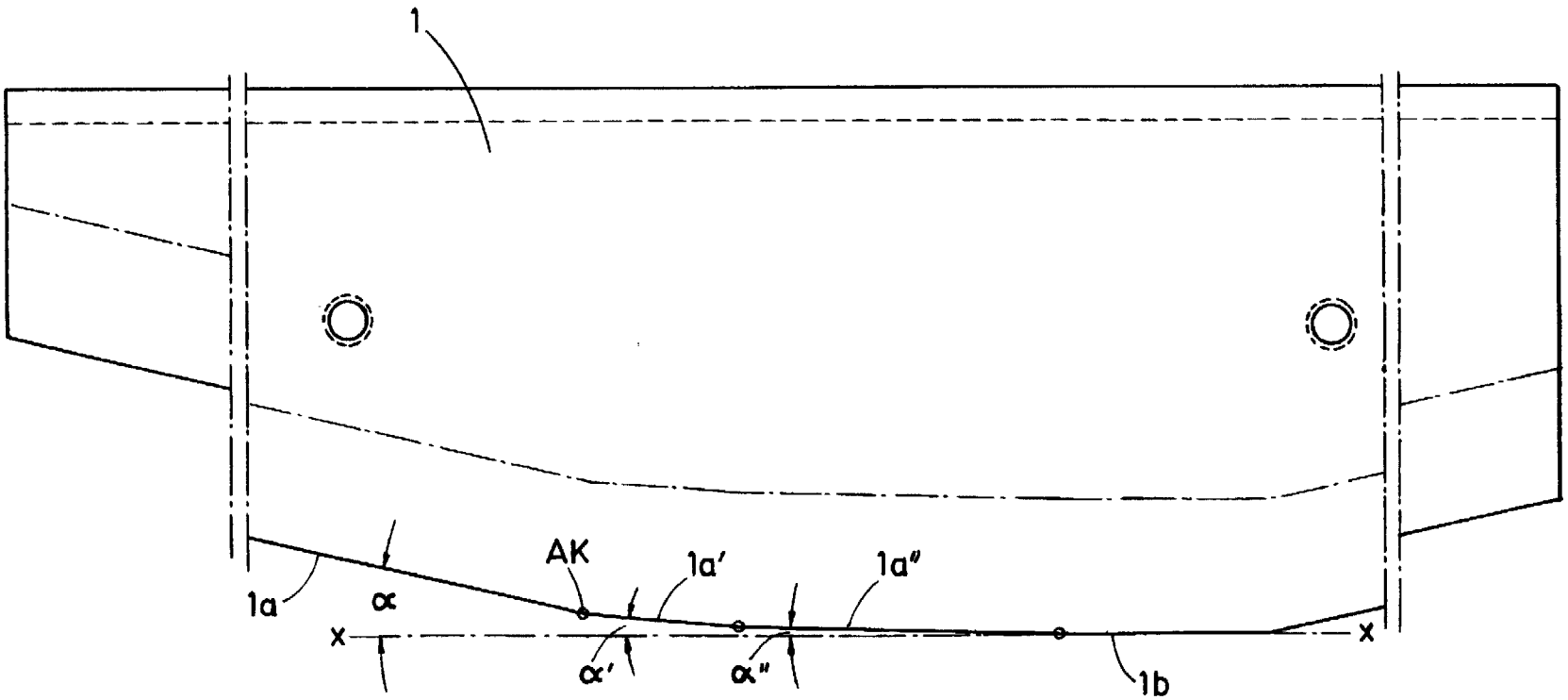
FIGS. 2, 3 and 4 are top views, similar to FIG. 1, of other embodiments of the upsetting tool.

The one part 1 of a pair of upsetting tools illustrated in FIG. 2 has a first upsetting surface 1*a* and a parallel upsetting surface 1*b*. The first upsetting surface 1*a* extends at an angle of inclination α relative to the plane x—x of the parallel upsetting surface 1*b*. The additional upsetting surfaces 1*a*' and 1*a*" are arranged following the transition edge AK of the first upsetting surface 1*a*. These two additional upsetting surfaces 1*a*' and 1*a*" extend at angles of inclination α1 and α2 relative to the plane x—x of the parallel upsetting surface 1*b* which are smaller than the angle of inclination α of the first upsetting surface 1*a* relative to the plane x—x.

Figure 3:
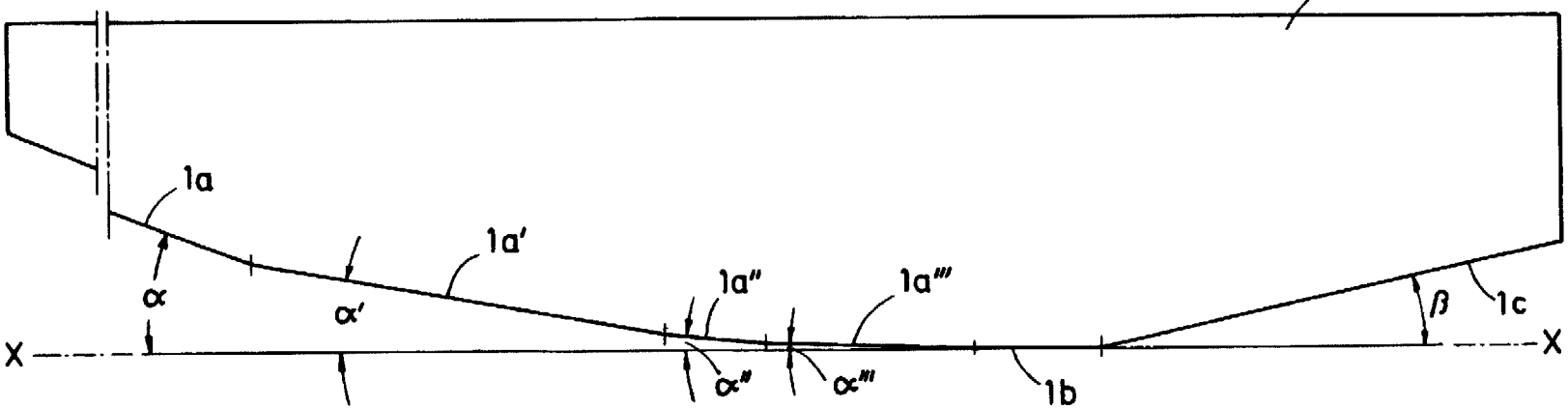

The upsetting tool illustrated in FIG. 3 has a first upsetting surface 1*a* which extends at an angle of inclination α relative to the plane x—x in which the parallel upsetting surface 1*b* is located. Arranged following the transition edge AK of the first upsetting surface 1*a* are additional upsetting surfaces 1*a*', 1*a*" and 1*a*'". These additional upsetting surfaces extend at angles of inclination α', α" and α'" relative to the plane x—x. The angles of inclination are smaller than the angle of inclination α of the first upsetting surface 1*a* relative to the plane x—x. The last of the additional upsetting surfaces 1*a*'" is followed by the parallel upsetting surface 1*b* and the upsetting surface 1*b* is followed by the inclined upsetting surface 1*c* having an angle of inclination β.

Figure 4:
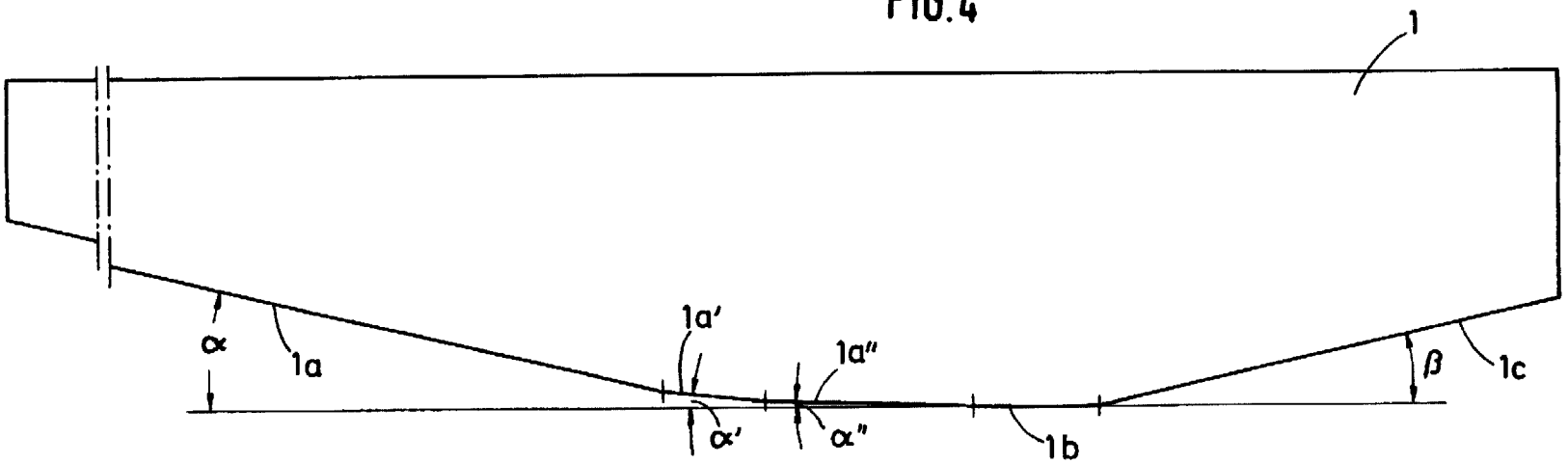

The configuration of the upsetting tool 1 illustrated in FIG. 4 corresponds to the configuration of FIG. 3 except that only two additional upsetting surfaces 1*a*' and 1*a*" follow the first upsetting surface 1*a*.

Figure 5:
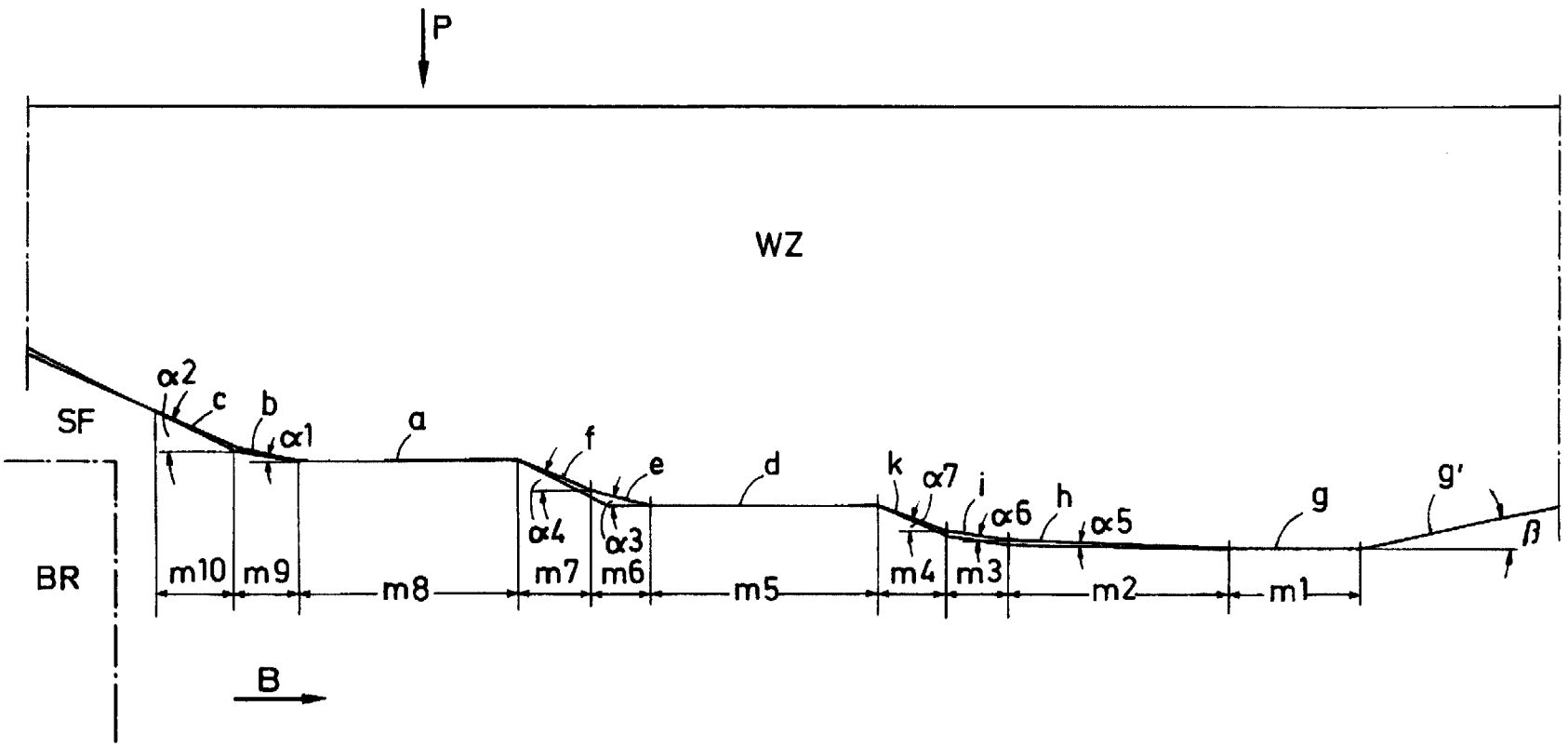
FIG. 5 is a top view of yet another embodiment of the upsetting tool.

As illustrated in FIG. 5 of the drawing, the upsetting tool WZ has a plurality of upsetting surfaces a–k whose purpose it is to act on the side surface SF of the slab BR shown in dash-dot lines during the movement of the upsetting tool WZ in the direction of arrow P. The portion of the upsetting surface which contacts the side surface SF first during this movement of the upsetting tool WZ is the upsetting surface a which extends parallel to the direction of movement B of the slab BR; in this embodiment, two inclined upsetting surfaces b, c are arranged in front of the upsetting surface a so as to form a type of polygonal configuration. The angle of inclination α1 of the surface b is smaller than the angle of inclination α2 of the surface c.

On the free side of the parallel upsetting surface a of this first group of upsetting surfaces a, b, c follow a second group of upsetting surfaces which, in a stepped relationship relative to the first group, also is composed of a parallel upsetting surface d and inclined upsetting surfaces e, f arranged in front of the upsetting surface d so as to form a polygonal configuration, wherein the angle of inclination α3 of the upsetting surface e is also smaller than the angle of inclination α4 of the upsetting surface f. The third and last group of these upsetting surfaces also has a parallel upsetting surface g and a polygonal configuration of inclined upsetting surfaces h, i, k with angles of inclination α5, α6, α7 arranged in front of the parallel upsetting surface g.

As is apparent in the illustrated embodiment, in the three groups of upsetting surfaces a, b, c; d, e, f and g, h, i, k, the inclined upsetting surface h of the third group and the two parallel upsetting surface a and d of the first and second groups have the same lengths m2, m5 and m8 as measured in the direction of movement of the slab. Also, the length ml of the parallel upsetting surface g of the third group is equal to the sum of the lengths m3+m4 of the upsetting surfaces i and k of this third group and to the sum of the lengths m6+m7 of the inclined upsetting surfaces e and f of the second group.

The aforementioned lengths can also be dimensioned and distributed differently depending on the operational requirements and experiences.

Figure 6:
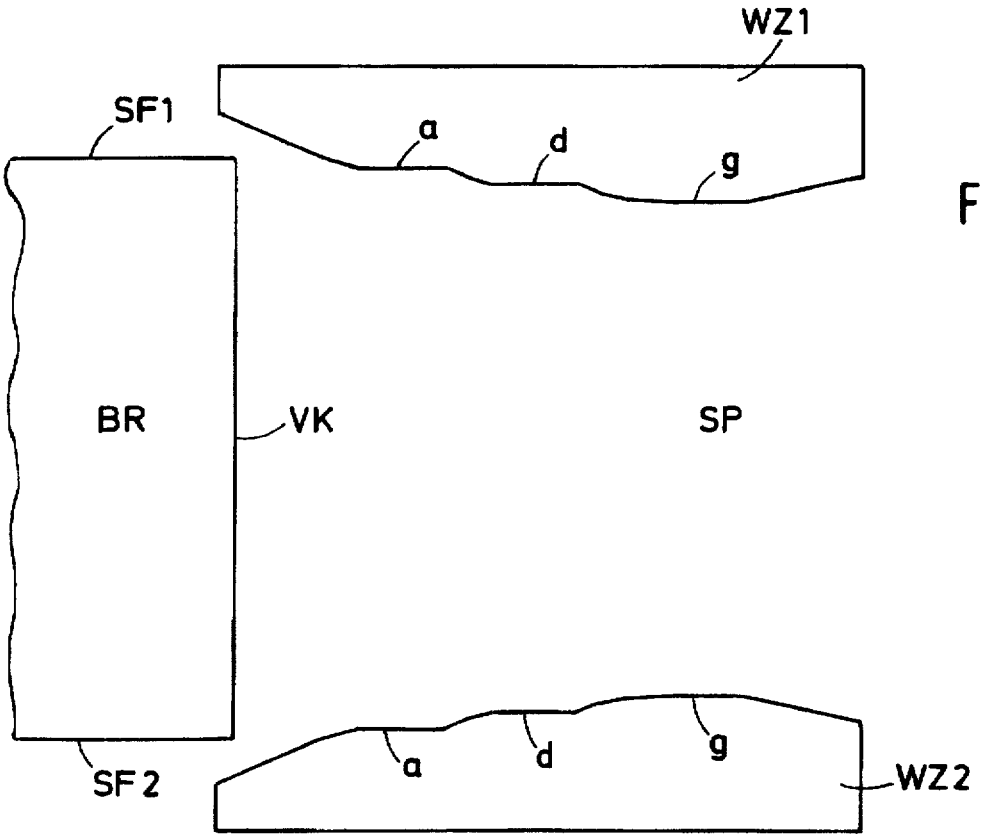
FIGS. 6–11 schematically show a pair of the upsetting tool of FIG. 5 in different positions during the upsetting procedures.
Figure 7:
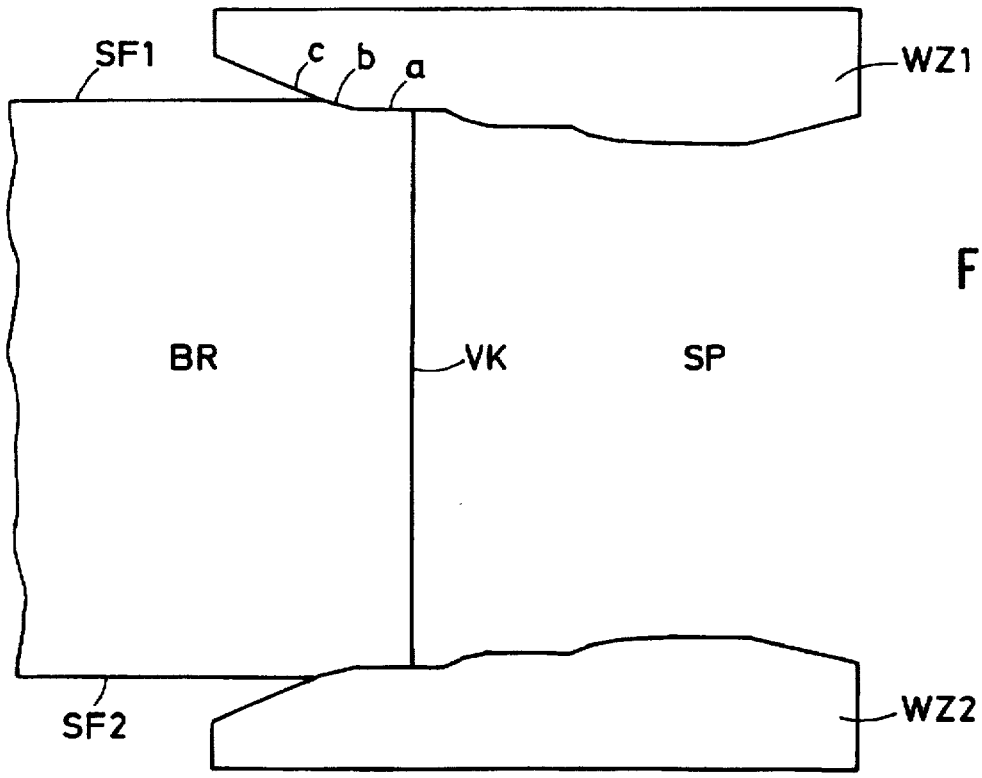
Figure 8:
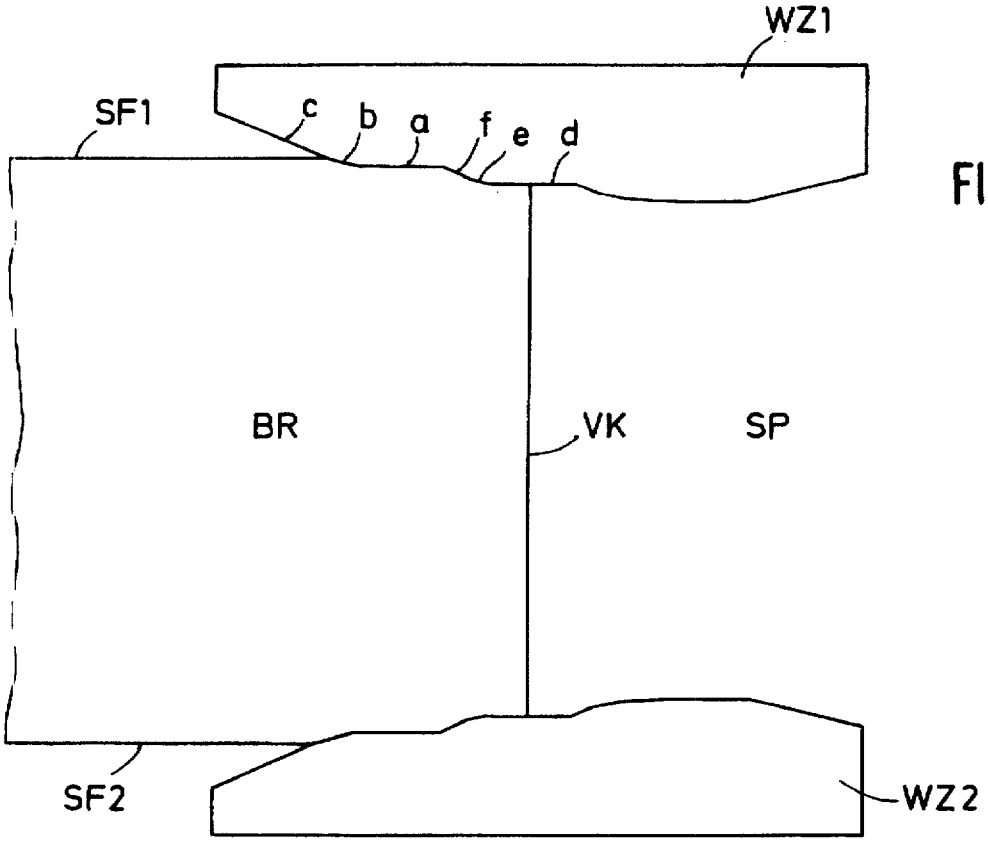
Figure 9:
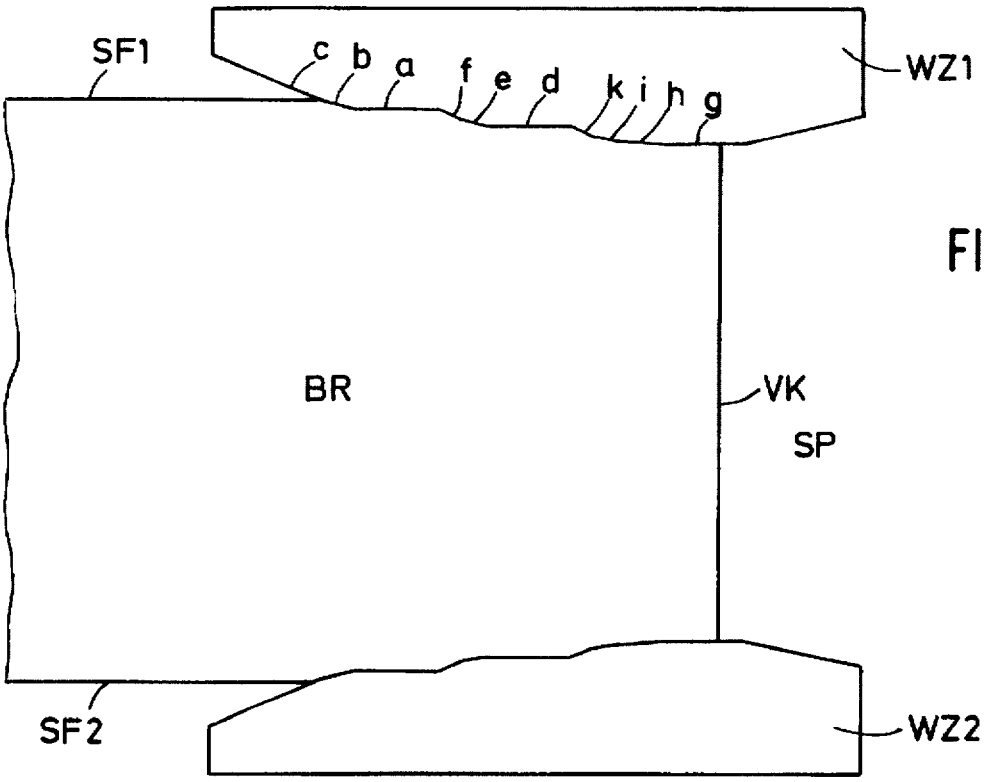
Figure 10:
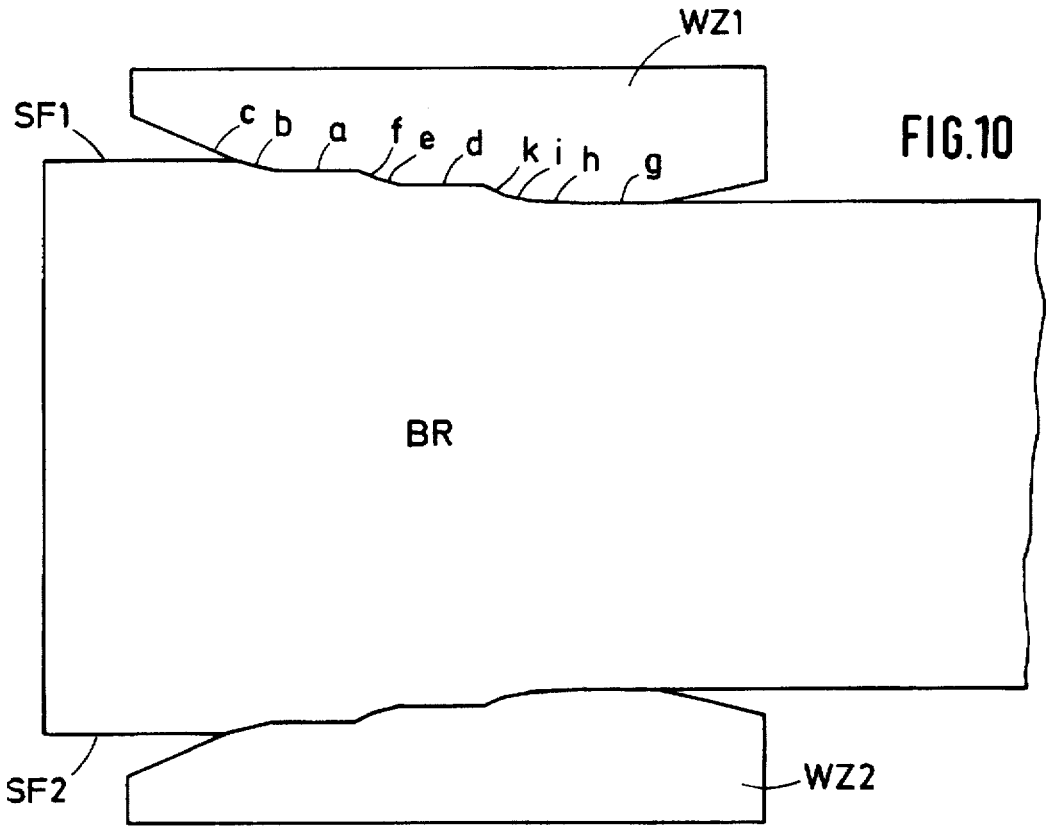
Figure 11:
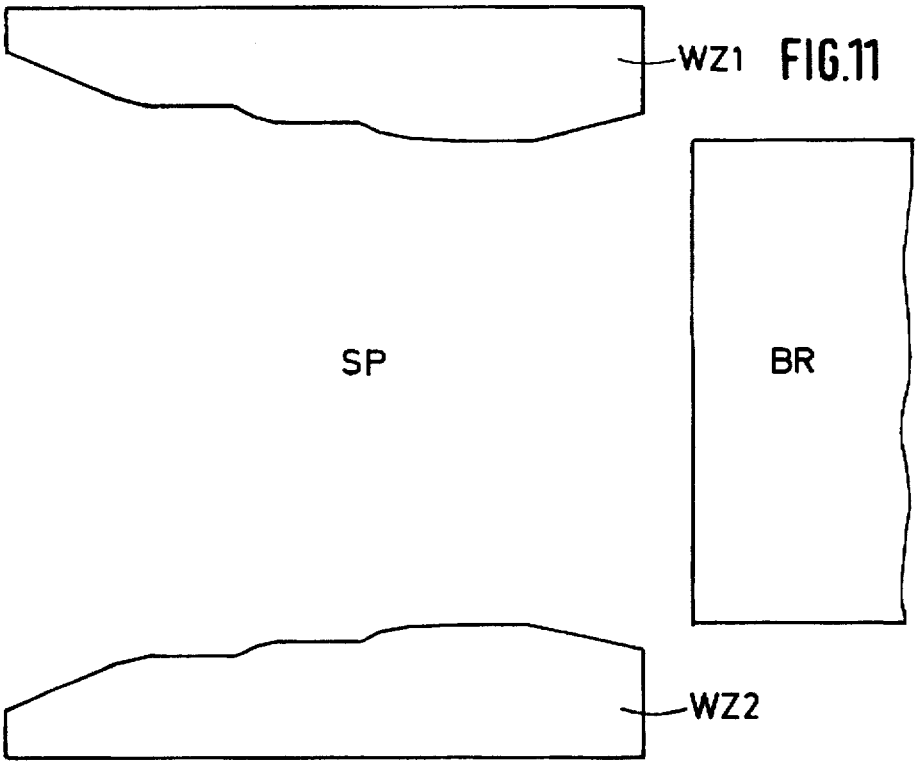

FIGS. 6–11 illustrate the manner of operation of the upsetting tools WZ1 and WZ2 of the pair of upsetting tools against the two side surfaces SF1 and SF2 of the slab BR. FIG. 6 shows the pressing gap SP formed by the upsetting tools WZ1 and WZ2 and the head of the slab BR which is being transported by a roller table, not shown. During the further transport in the direction toward the pressing gap SP, the slab head is positioned in such a way that the front edge VK is located approximately below the middle of the parallel upsetting surface a of the first group of upsetting surfaces. The upsetting tools WZ1 and WZ2 then carry out a first upsetting stroke toward each other and upset the slab head into the shape illustrated in FIG. 7. This is effected by applying all upsetting surfaces a, b, c of the first group of upsetting surfaces against the side surfaces SF1 and SF2 of the slab. Subsequently, the two upsetting tools WZ1 and WZ2 are moved apart from each other and the slab head is advanced into a position in which the front edge of the slab head is located approximately below the middle of the following parallel upsetting surfaces d of the second group of upsetting surfaces. By carrying out a subsequent second upsetting stroke, the slab head is formed into the shape illustrated in FIG. 8 by a simultaneous application of the upsetting surfaces d, e, f of the second group of upsetting surfaces and the upsetting surfaces a, b, c of the first group of upsetting surfaces against the side surfaces SF1 and SF2 of the slab. Subsequently, after once again opening the pressing gap SP, the front edge VK of the slab head is moved approximately underneath the middle of the parallel upsetting surfaces g of the third group of upsetting surfaces and during the following upsetting stroke, all upsetting surfaces g, h, i, k; d, e, f and a, b, c of the third, second and first group of the upsetting surfaces act against the side surfaces SF1 and SF2 of the slab head and produce the shape illustrated in FIG. 9. As a result of these three upsetting strokes, the width of the slab head is reduced to the intended magnitude as shown in FIG. 10, and the remaining length of the slab which is not yet deformed is reduced in the same manner during additional upsetting strokes. As shown in FIG. 11, the slab BR is then moved out of the pressing gap SP.

While specific embodiments of the invention have been shown and described in detail to illustrate the inventive principles, it will be understood that the invention may be embodied otherwise without departing from such principles.

We claim:

1. An upsetting tool of a pair of upsetting tools for deforming continuously cast slabs in a slab upsetting press, wherein the slab is moved through the slab upsetting press in a travel direction, the slab having side surfaces, the upsetting tool comprising a plurality of upsetting for acting on one of the side surfaces of the slab, the upsetting surfaces comprising a parallel upsetting surface extending parallel to the travel direction of the slab, a first upsetting surface located in travel direction in front of the parallel upsetting surface, and at least two additional upsetting surfaces between the first upsetting surface and the parallel upsetting surface, wherein the first upsetting surface and the at least two additional upsetting surfaces have angles of inclination relative to the travel direction of the slab, the angles of inclination of the at least two additional upsetting surfaces being smaller than the angle of inclination of the first upsetting surface, the parallel upsetting surface extending in a plane, wherein a first of the at least two additional upsetting surfaces has a length measured in the plane of the parallel upsetting surface which is smaller than a length of a second of the at least two additional upsetting surfaces measured in the plane of the parallel upsetting surface.

2. The upsetting tool according to claim 1, comprising two additional upsetting surfaces, wherein the angles of inclination of the two additional upsetting surfaces are equal.

3. The upsetting tool according to claim 1, wherein the length of the first additional upsetting surface is approximately half the length of the second additional upsetting surface.

4. The upsetting tool according to claim 1, comprising two additional upsetting surfaces, wherein the first upsetting surface has an angle of inclination of 11° to 13° and the two additional upsetting surfaces have angles of inclination of about 0.5° to 8°.

5. The upsetting tool according to claim 4, wherein the angle of inclination of the first additional upsetting surface following the first upsetting surface in travel direction of the slab is 4° to 8° and the angle of inclination of the second additional upsetting surface following the first additional upsetting surface is 0.5° to 2°.

6. The upsetting tool according to claim 5, wherein the angle of inclination of the first additional upsetting surface is 5° and the angle of inclination of the second additional upsetting surface is 1°.

7. The upsetting tool according to claim 1, comprising three additional upsetting surfaces, wherein the angle of inclination of the first upsetting surface is about 19° to 20°, and the three additional upsetting surfaces each have an angle of inclination of about 0.9° to 10°.

8. The upsetting tool according to claim 7, wherein the angle of inclination of the first upsetting surface is 19.8° and the angle of inclination of each additional upsetting surface is 0.91° to 9.8°.

9. The upsetting tool according to claim 7, wherein a first of the three additional upsetting surfaces arranged following the first upsetting surface in travel direction of the slab has an angle of inclination of 9.1°, a second of the three additional upsetting surfaces following the first additional upsetting surface having an angle of inclination of 5.2° and a third of the three additional upsetting surfaces following the second additional upsetting surface having an angle of inclination of 0.91°.

10. The upsetting tool according to claim 9, wherein the first upsetting surface has an angle of inclination of 12°, the first additional upsetting surface has an angle of inclination of 5.2° and the second additional upsetting surface has an angle of inclination of 9.1°.

11. The upsetting tool according to claim 1, comprising at least two groups of upsetting surfaces, each group of upsetting surfaces comprising a parallel upsetting surface extending in travel direction of the slab, and inclined upsetting surfaces in front of each parallel upsetting surface, wherein the inclined upsetting surfaces form a polygonal configuration, and wherein the angles of inclination of the additional upsetting surfaces increase against the travel direction of the slab.

12. The upsetting tool according to claim 11, wherein the upsetting tool comprises three groups of upsetting surfaces.

13. The upsetting tool according to claim 12, wherein the three groups of upsetting surfaces include a first group, a second group and a third group arranged one behind the other in travel direction of the slab, wherein a first of the inclined upsetting surfaces of the third group arranged in front of the parallel upsetting surface and the parallel upsetting surfaces of the first and second group are of equal length, and wherein the length of the parallel upsetting surface of the third group is equal to a sum of the lengths of the inclined upsetting surfaces of the third group and to a sum of the lengths of the inclined upsetting surfaces of the second group.

14. The upsetting tool according to claim 13, wherein a last inclined upsetting surface of the first group is slightly longer than the length of a last inclined upsetting surface of the third group and than a last inclined upsetting surface of the second group.

15. The upsetting tool according to claim 14, wherein the angles of inclination of the last inclined upsetting surface of the first, second and third groups are between 23° and 20°, the angles of inclination of the first and second inclined upsetting surfaces of the first, second and third group are between 8° and 12.1°, and the angle of inclination of the first inclined upsetting surface of the last group is about 2.0° to 3.0°.

16. The upsetting tool according to claim 15, wherein the angle of inclination of the last inclined upsetting surface of the first group is 22.18°, the angle of inclination of the last inclined upsetting surface of the second group is 23.63° and the angle of inclination of the last inclined upsetting surface of the third group is 20.56°, the angle of inclination of the second and third inclined upsetting surfaces of the first group is 8.13°, the angle of inclination of the first and second inclined upsetting surfaces of the second group is 12.09° and the angle of inclination of the first and second inclined upsetting surfaces of the third group is 8.13°, and the angle of inclination of the first inclined upsetting surface of the last group is 2.29°.

17. The upsetting tool according to claim 12, wherein an inclined transition surface is arranged following the parallel upsetting surface of the last group of the three groups of upsetting surfaces.

18. The upsetting tool according to claim 17, wherein the transition surface has an angle of inclination of about 12° to 13°.

19. The upsetting tool according to claim 18, wherein the transition surface has an angle of inclination of 12.09°.

* * * * *